US007360596B2

(12) United States Patent
Steinbrecher et al.

(10) Patent No.: US 7,360,596 B2
(45) Date of Patent: Apr. 22, 2008

(54) METHOD AND DEVICE FOR INTENSIFYING THE PERMEABILITY OF GROUND LAYERS CLOSE TO BORE HOLES AND FILTER BODIES AND FILTER LAYERS IN WELLS AND OTHER PRODUCTION WELLS

(75) Inventors: Alexander Steinbrecher, St. Barbara Ring 15, 04416 Markkleeberg (DE); Karsten Kahle, Bad Schmiedeberg (DE)

(73) Assignee: Alexander Steinbrecher, Markkleeberg (DE)

( * ) Notice: Subject to any disclaimer, the term of this patent is extended or adjusted under 35 U.S.C. 154(b) by 285 days.

(21) Appl. No.: 10/541,945

(22) PCT Filed: Jan. 8, 2004

(86) PCT No.: PCT/EP2004/000056

§ 371 (c)(1),
(2), (4) Date: Jul. 8, 2005

(87) PCT Pub. No.: WO2004/063524

PCT Pub. Date: Jul. 29, 2004

(65) Prior Publication Data

US 2006/0137872 A1 Jun. 29, 2006

(30) Foreign Application Priority Data

Jan. 15, 2003 (DE) ..... 103 01 338
Dec. 18, 2003 (DE) ..... 103 61 983

(51) Int. Cl.
*E21B 37/08* (2006.01)

(52) U.S. Cl. ..... 166/250.02; 166/249; 166/63; 166/177.2

(58) Field of Classification Search ..... 166/249, 166/250.02, 177.1, 177.2
See application file for complete search history.

(56) References Cited

U.S. PATENT DOCUMENTS

| | | | | |
|---|---|---|---|---|
| 6,427,774 | B2 * | 8/2002 | Thomas et al. | 166/248 |
| 2001/0017206 | A1 | 8/2001 | Davidson et al. | |
| 2002/0153135 | A1 * | 10/2002 | Troutt et al. | 166/249 |
| 2004/0069530 | A1 * | 4/2004 | Prain et al. | 175/40 |

FOREIGN PATENT DOCUMENTS

| | | |
|---|---|---|
| DE | 195 37 689 | 4/1996 |
| DE | 198 43 292 | 4/2000 |
| DE | 199 32 593 | 5/2001 |
| DE | 199 13 239 | 8/2001 |

* cited by examiner

*Primary Examiner*—David Bagnell
*Assistant Examiner*—Sean D Andrish
(74) *Attorney, Agent, or Firm*—Collard & Roe, P.C.

(57) ABSTRACT

The invention relates to a method for intensifying the permeability of ground layers close to bore holes and filter bodies and filter layers (W) in the underground extraction areas (F) of wells and other production drill holes (11) wherein liquid is continuously pumped away in the extraction area (F) of the drill hole (11) by means of an underground pump (8). The liquid which is thus displaced is successively impinged upon with hydraulic energy pulses (E) in the direction of the walls of the drill hole, filter bodies and filter layers (W) by continually moving a pulse generator (1) up and down in the area of extraction (F) The effect of each energy pulse (E) is evaluated by means of seismic measurements and the parameters of the following energy pulses (E) are determined according to the evaluation of the measuring result of the previous energy pulse (E).

10 Claims, 3 Drawing Sheets

METHOD AND DEVICE FOR INTENSIFYING THE PERMEABILITY OF GROUND LAYERS CLOSE TO BORE HOLES AND FILTER BODIES AND FILTER LAYERS IN WELLS AND OTHER PRODUCTION WELLS

CROSS REFERENCE TO RELATED APPLICATIONS

Applicant claims priority under 35 U.S. §119 of German Application Nods. 103 01 338.5 and 103 61 983.6 filed Jan. 15, 2003 and Dec. 18, 2003, respectively. Applicants also claim priority under 35 U.S. §365 of PACT/EP2004/000056 filed Jan. 8, 2004. The international application under PACT article 21(2) was not published in English.

The invention relates to a method and a device by means of which the permeability of ground layers close to boreholes and of filter bodies and filter layers introduced into the borehole in water wells and other production wells can be intensified.

In water wells and other production wells, solids and encrustations are deposited during operation in ground layers close to the borehole and in filter bodies and filter layers introduced into the borehole. These encrustations increasingly impair permeability to the liquid medium to be extracted.

Various methods and devices for counteracting the resulting decrease in production are known from the prior art.

The German patent DE 195 37 689 C2, for example, describes a well regeneration method in which a cylindrical body is lowered between two wire pulleys acting as centering means into a well. By opening a valve in this cylindrical body, a highly pressurised gas is blown against the wall of the well. This gas impinges on the wall of the well as a pulsating pressure wave. The valve opening times, the volume of gas released and the gas pressure can be set before commencement of the well regeneration work.

The disadvantage of this method is that during well regeneration work, it does not allow any concurrent and immediate adjustment of the gas pressure, gas volume and valve opening times to suit the hydraulic properties of the well and the surrounding ground as they change with each pulse of gas, and that the valve is not opened by a signal at an exactly defined point in time. Moreover, the specified pressure of 10 to 25 bar does not guarantee any great depth of penetration into the ground layers close to the borehole and requiring regeneration, or into the filter bodies and filter layers.

The DE 199 32 593 C1 describes another method, in which at least one vertical working section that is partitioned off from the rest of the borehole by two packer elements is charged with a pulsating gaseous or liquid pressure medium. Any water and/or the pressure medium is pressed through the filter walls into the surrounding filter gravel layers. A pressure vessel that serves as a buffer store is provided in the immediate vicinity of the working section in order to prevent pressure losses in the pressure lines.

The principle by which a regeneration effect is obtained with this method consists in the action of a pulsating gaseous or liquid pressure medium on the working section and the resulting pressing of well water and/or pressure medium through the screen slots into the filter gravel layers; in other words, the principle consists merely in displacing a volume through the screen slots.

Another method is proposed in the patent application DE 198 43 292.5, according to which the sudden decompression of a compressed gas or pressurised liquid generates pulses in the well. On account of the sluggish material used in the counter-pressure chamber, the device used in this method opens and closes too slowly to generate a kinetic energy pulse. Plus, with this method too, the regeneration effect consists merely in a pressure-alternating volume displacement.

Finally, a well regeneration method is known in which pressure pulses are generated by means of explosive charges. Use of this method is by no means possible in every well since the pressure pulses generated, being very energy-intensive and practically impossible to control, can lead to destruction of the well lining.

All the known methods are based on the common principle of pressing the well medium or a foreign medium through the screen slots into the surrounding filter and/or ground layer by means of brief, sometimes pulsating volume displacement in the suction zone of the production well. The necessary volume displacement is effected by the release—which differs in speed from process to process—of a usually fairly large volume of a pressurised foreign medium (industrial gas, explosive gas, liquid).

With the known methods, the principle of volume displacement limits the range of action into the borehole surroundings, since, as is known, the compressibility of liquids is low. Only when an explosive is used is an energy pulse generated in the liquid due to the very high speed at which the explosive reacts chemically. The energy pulse generated in this method makes for a long action range, but at the same time, the reaction is so fast that it produces a very "hard" pulse, and this, in turn, constitutes a high risk to the borehole and the well lining.

The object of the invention is thus to provide a method and a device for intensifying the permeability of ground layers close to boreholes and of filter bodies and filter layers in water wells and other production wells, which makes it possible to intensify the permeability of ground layers close to boreholes and of filter bodies and filter layers more efficiently than is possible with methods and devices known from the prior art, and without any risk of destroying the borehole and its linings.

As far as the method is concerned, this object is established by the characterizing features of claim 1, and as far as the device is concerned, by the characterizing features of claim 7.

Useful embodiments of the method form the features of the sub-claims 2 to 6, while useful embodiments of the device form the features of the claims 8 to 11.

The invention will now be explained in more detail on the basis of preferred embodiments and by reference to the FIGS. 1 to 3.

Figure 1:
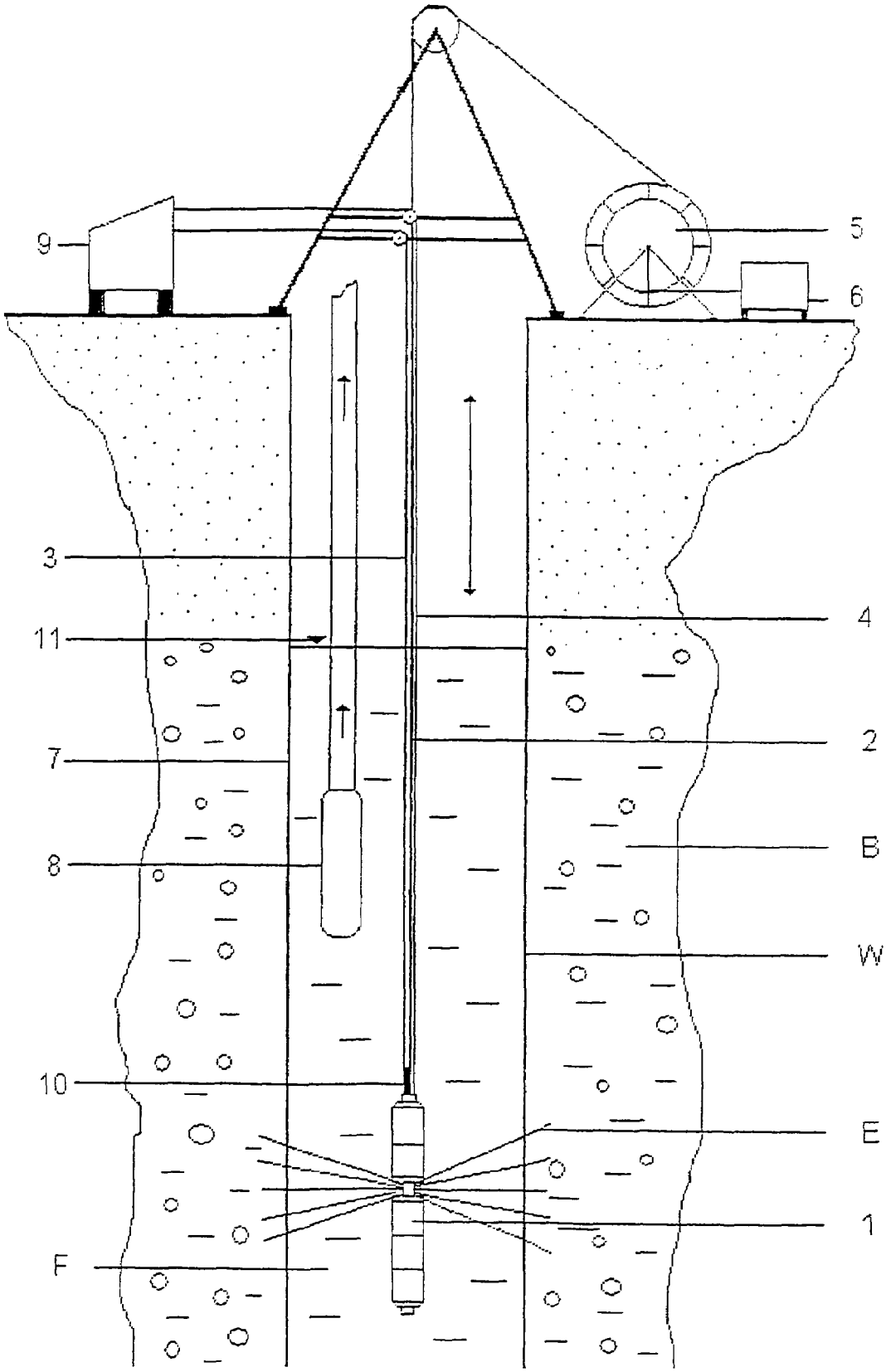
FIG. 1 is a schematic diagram showing a longitudinal section through a production well with a device according to the invention suspended therein.
Figure 2:
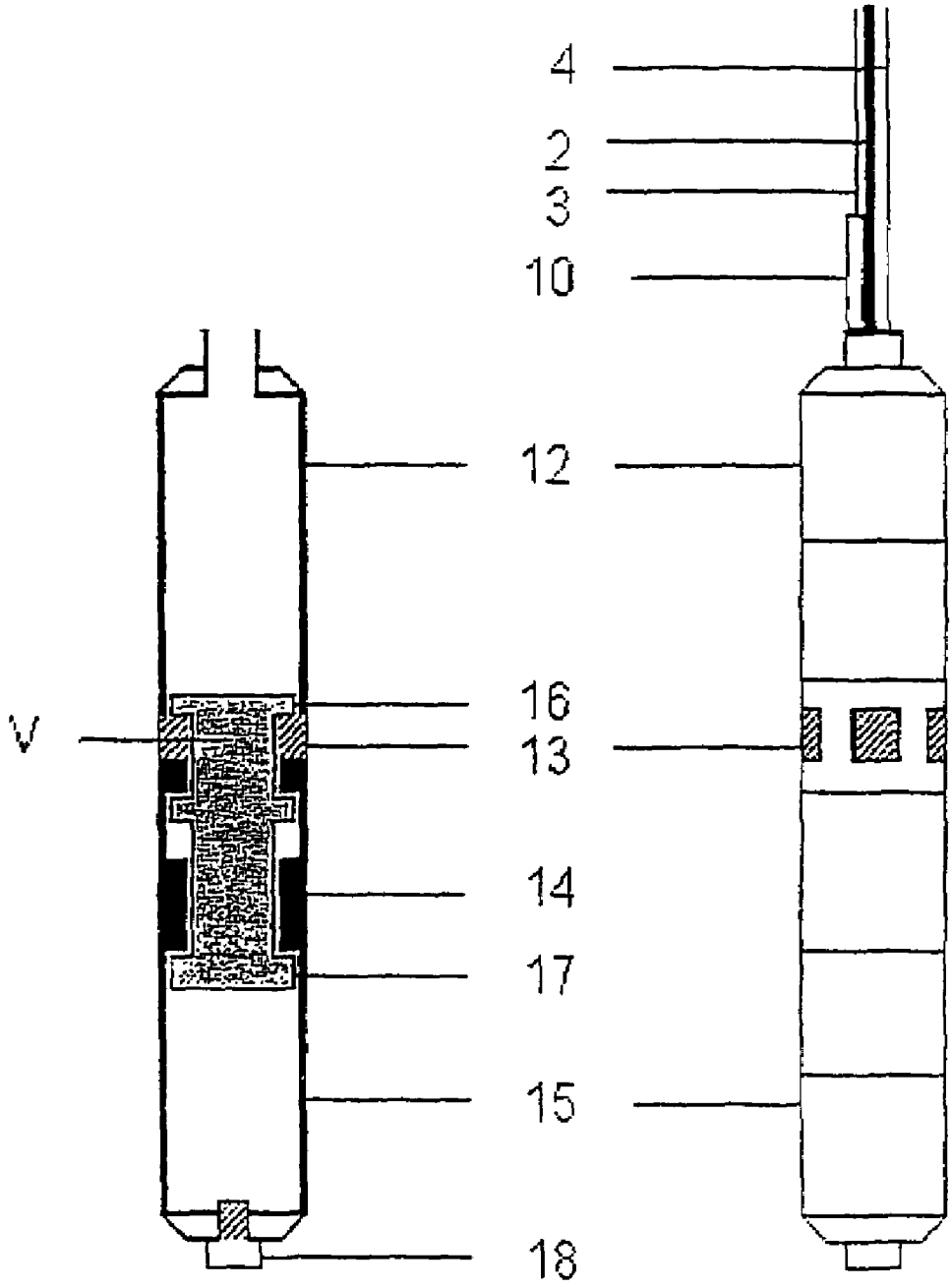
FIG. 2 shows details of the structure of a device used to carry out the method of the invention.
Figure 3:
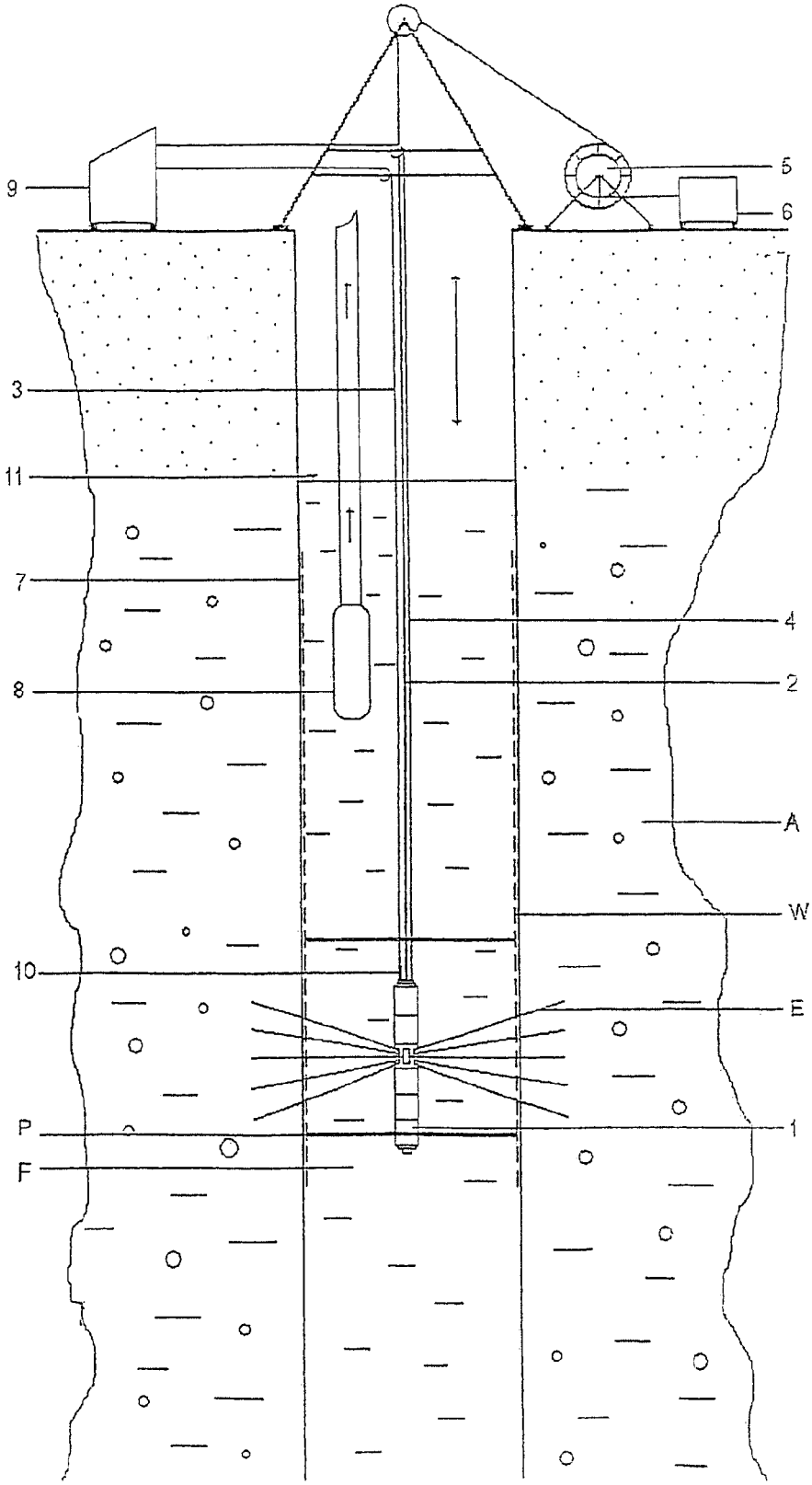
FIG. 3 shows, in a view similar to that of FIG. 1, a production well with a modified device according to the invention suspended therein.

With the method of the invention and the associated device, a very small volume of liquid that is subjected to kinetic energy pulses which, as a rule, are of very high intensity, is used to generate a hydraulic energy pulse E in the extraction area F of the production well 11 under parameters that can be precisely monitored and controlled by instrumentation. The energy pulse E is reinforced in its effectiveness by a dynamic current generated continuously by an underground pump 8. As seen in FIGS. 1 to 3, a surface pressure unit 6 presses a liquid (in the case of a water well, for example, water from this well) under high pressure (up to 150 bar) into a pressure line 2 at the end of which is a pulse generator 1 provided with a large-area valve that is able to open and close again within 1 to 2 milliseconds and, within this very short time, to release a very small, exactly pre-defined volume of the highly pressurised liquid (about 300 ml) into the liquid to be extracted, e.g. The surrounding well water. On account of the small volume used, the effect of the volume displacement is minor; of much greater significance is the fact that the violent impact of the small liquid volume released with high kinetic energy makes the well-water molecules oscillate, and the hydraulic energy pulse E generated as a result propagates on account of the physical phenomenon as a pulse flow through the screen slots and into the liquid surrounding the production well 11. This oscillation of the liquid molecules causes encrustations on the inside and the outside of the screen to detach at their respective locations, and fine-grained material, for example, to move out of the filter-gravel wall.

Since the method provides for simultaneous generation of a dynamic current in the production well 11 and its surroundings by continuous, controllable pumping away of liquid by means of an underground pump 8, all matter removed from its previous location by the hydraulic energy pulse E is pumped away immediately.

Continuous pumping away is made possible by the fact that the method of the invention uses tiny volumes of liquid, so that no rising gas bubbles are generated. During well regeneration, the pulse generator 1 is moved in defined manner up and down inside the borehole 7 in the extraction area F by means of a hose reel 5.

The control signal for opening the valve of the pulse generator 1 is transmitted as an electrical signal from the control unit 9 via a control cable 4 to the pulse generator 1.

The electromagnet 14 is energized momentarily by the control signal, and the valve disk 16 attached to an electromagnetically operated valve piston V opens the working chamber 12. The liquid previously impounded here and provided with kinetic energy escapes within 1 to 1.5 milliseconds through the outflow apertures 13 into the surrounding liquid to be extracted.

The energizing of the electromagnet 14 simultaneously causes the lower valve disk 17 attached to the electromagnetically operated valve piston V to be pushed downwards against the pressure of a liquid in the valve-closing chamber 15. Immediately after the pressure reduction of the volume in the working chamber 12, the pressure prevailing in the valve-closing chamber 15 forces the lower valve disk 17 abruptly back again in the opposite direction, thus closing the valve 13 again after about 2 to 2.5 milliseconds. Both the amount and the pressure of the liquid volume contained in the valve-closing chamber 15 may be varied via a closing valve 18 actuated by the control unit 9.

The volume of the working chamber 12 may likewise be varied under operating conditions by way of the control unit 9. This means that the physical parameters of the device and thus the intensity of the kinetic energy pulse E that is generated can be adapted to all variants of production wells 11 and their diameters. There are no limitations regarding the depth at which the method can be implemented in the production wells 11.

Mounted on the pulse generator 1 is a sensor 10 that continuously registers the energetic and time-dependent characteristics of the energy pulses E and transmits them via an instrument lead 3 to the control unit 9 at the surface. Here, on the basis of the pulse action characteristics registered by the sensor 10, of changes in the dynamic water level in the production well 11 and of changes registered at the pump outflow point in the discharge of dissolved colmatants, the operator is able to control the working pressure of the liquid in the pulse generator 1 and the delivery volume of the underground pump 8.

Thanks to the parameters determined by means of the sensors 10, the method of the invention can be controlled precisely and is thus able, during the regeneration of a production well 11, to continuously adjust itself precisely to the conditions of the producing well's hydraulic system as they change during the course of the regeneration work. No interruption in the regeneration process is necessary.

In addition, on account of the complex measurability and controllability of its physical parameters, the method of the invention can be adapted to every known well lining of the production well 11.

If the filter material is very brittle, as is the case, for example, with stoneware or aged PVC, the hydraulic energy pulses must have only a low energy content so as to ensure that in this case, too, the brittle materials are neither damaged nor destroyed. If, in addition to the filter material being very brittle, it contains a particularly large quantity of colmatage (e.g. due to an extended period of operation without regeneration, or to an extremely high iron content in the medium being extracted), regeneration will take a long time on account of the low energy content of the pulses. Alternatively, if regeneration work is limited to a justifiable period of time, the permeability of the filter bodies, the filter layers and of ground layers B close to the borehole will not be intensified to the desired degree.

In this case, the method and the device of the invention are modified in the manner illustrated in FIG. 3 and described below.

The production well 11 illustrated in FIG. 3 is a water well for supplying drinking water.

To start with, work proceeds in the previously described manner on the well to be regenerated. Since the screen W—shown in section schematically as a dashed line in FIG. 3—of the well to be regenerated consists of very brittle material, the energy for the hydraulic energy pulses is selected to be very low so as to ensure the prevention of any damage to the screen W. The very low energy input would considerably prolong the regeneration work. If, in addition, the filter layers contain a particularly large quantity of colmatage, which can happen if the well is operated for too long without regeneration or if the ground water has a very high iron content, it is possible that at the low energy-input level, the regeneration work will take a disproportionately long time or, if regeneration has to be completed within a justifiable period of time, that the filter layers will not be freed entirely of colmatants.

In such cases, therefore, the previously described method is discontinued or interrupted once the internal surfaces have been cleaned and the apertures in the screen W have been unclogged. The pulse generator 1 and the underground pump 8 are temporarily withdrawn from the production well 11, and the pulse generator 1 is provided at its upper and lower ends with packer disks P that correspond with the internal diameter of the screen W installed in the production well 11. The pulse generator 1 provided with the packer disks P is then lowered to a terminal section of the screen W, and, by means of the pressure unit 6, a regenerating liquid, e.g. one that is commercially available, is pulsed or pressed via the pressure hose 2 and the pulse generator 1 with weak energy pulses E through the now unclogged apertures in the screen W into the surroundings of the production well 11, i.e. in the case of water-well regeneration, into the aquifer A. This procedure is repeated successively in sections corresponding approximately to the distance between the packer disks P on the pulse generator 1 until the other end of the screen W is reached. The pulse generator 1 along with the packer disks P attached to it is then withdrawn again from the production well 11, and the underground pump 8 is lowered into the production well 11 again. After the regenerating liquid has been allowed to act for a defined period, the underground pump 8 is restarted and the regenerating liquid is pumped out completely, along with the dissolved colmatants. This operation is followed, as is standard practice following a well regeneration process, by intensive water withdrawal.

To intensify the cleaning effect of the above-described modified process of the invention, the packer disks P are detached again from the pulse generator 1 following the process of pulsing and pressing in of regenerating liquid and subsequent renewed withdrawal of the pulse generator 1 and the underground pump 8 from the production well 11; the pulse generator 1 and the underground pump 8 are then lowered once more into the production well, and the regeneration fluid allowed to act for a defined period while the pulse generator 1 moves to and fro and simultaneously emits successive, weak, hydraulic energy pulses. The regenerating liquid is subsequently pumped out completely, along with the dissolved colmatants, by means of the underground pump 8.

By virtue of the two last-mentioned modified embodiments of the invention, the method of intensifying the permeability of ground layers close to boreholes and of filter bodies and filter layers in the underground extraction areas of water wells and other production wells is particularly suitable for the regeneration of water wells with especially brittle screens, e.g. of stoneware or of aged PVC, where, in addition, the filter layers contain a particularly large quantity of colmatage.

The invention claimed is:

1. A method for intensifying permeability of ground layers close to boreholes and of filter bodies and filter layers in an underground extraction area of water wells and other production wells comprising the steps of:

(a) continuously pumping away liquid in an extraction area of a borehole by an underground pump;

(b) continuously moving a pulse generator up and down in the extraction area to cause energy pulses generated by a surface pressure unit that is connected in leak-proof manner via a pressure line with the pulse generator being moved in the extraction area, the pressure line introducing a pressure line liquid in the pulse generator and said pressure unit exerting a high pressure on the pressure line liquid as a hydraulic pulse at a defined pressure and for a defined duration out of the pulse generator into the liquid to be extracted to successively impinge the liquid toward borehole walls and filter bodies and filter layers in the underground extraction area;

(c) using seismic measurements to obtain a respective evaluation of an effect of each energy pulse; and (d) determining parameters of a following energy pulse according to the evaluation of a previous energy pulse.

2. The method according to claim 1, wherein the respective effect of each energy pulse is registered by means of a seismic sensor installed in situ on the pulse generator, transmitted via an instrument lead to a control unit located at the a surface outside the extraction area and evaluated, and wherein after evaluation of the effect of an energy pulse, the parameters of the following energy pulse are defined by adjusting the pressure exerted by the pressure unit and by at least one control signal that is transmitted via a control cable and triggers the pulse generator at a defined time.

3. The method according to claim 2, wherein a plurality of control signals are transmitted to the pulse generator to trigger the pulse generator at the defined time, to set a liquid volume for the hydraulic pulse and to define the duration of the energy pulse.

4. The method according to claim 1, wherein regeneration work is performed with weak energy pulses to clean internal surfaces and apertures in a screen of a production well, the screen having an internal diameter and first and second ends, the regeneration work starting at the first end, and, after the internal surfaces have been cleaned and the apertures in the screen unclogged, the regeneration work is discontinued or interrupted, wherein the pulse generator and the underground pump are temporarily withdrawn from the production well and the pulse generator is provided at upper and lower ends of the pulse generator with packer disks that correspond to the internal diameter of the screen, each packer disk being separated from another packer disk by a respective distance, that wherein thereafter, a procedure is performed wherein the pulse generator provided with the packer disks is lowered to a terminal section of the screen and, by means of the pressure unit, a regenerating liquid is pulsed or pressed via the pressure line and the pulse generator with weak energy pulses through the unclogged apertures in the screen into an aquifer surrounding the production well, the procedure being repeated successively in sections corresponding approximately to the distance between the packer disks on the pulse generator until the second end of the screen has been reached, wherein the pulse generator is withdrawn again from the production well, the underground pump is lowered once more into the production well and the regenerating liquid, after a defined period of action is, pumped out completely along with dissolved colmatants by the underground pump.

5. The method according to claim 4, wherein after pulsing and pressing of the regenerating liquid and subsequent withdrawal of the pulse generator and the underground pump from the production well, the packer disks are detached again from the pulse generator and the pulse generator and the underground pump are then lowered once more into the production well, and wherein the regenerating liquid, after a defined period of action during concurrent up-and-down movement of the pulse generator and simultaneous, successive emission of weak hydraulic energy pulses by the pulse generator, is pumped out completely, along with the dissolved colmatants, by means of the underground pump.

6. A device for carrying out the method of claim 1, comprising the pulse generator that is lowered into the extraction area of the borehole and moved up and down in said extraction area, a seismic sensor installed on the pulse generator, a surface-located control unit that is connected via an instrument lead and a control cable to the seismic sensor and the pulse generator respectively, the surface-located pressure unit connected via the pressure line to the pulse generator, and the underground pump that can be lowered into the extraction area of the borehole.

7. The device according to claim 6, wherein the pulse generator comprises: a cylinder in the upper portion of which a working chamber of variable volume is located, said working chamber being connected with the pressure line and having outflow apertures that are closed in the non-operative state, and in the lower portion of which a valve-closing chamber is located, the two chambers being operatively interconnected by an electromagnetically operated valve piston that is moved downwards by momentary activation of an electromagnet, thereby opening—by means of an upper valve disk attached to the valve piston—the outflow apertures and releasing the excessive pressure in the working chamber as the hydraulic pulse; when the valve piston moves down, a lower valve disk attached thereto causes a strong pressure increase in the valve-closing chamber, and immediately after the pressure in the working chamber has been reduced, the valve piston is pushed back into its starting position by means of the valve disk.

8. The device according to claim 6, wherein the liquid volume and the pressure in the valve-closing chamber are controllable via a closing valve.

9. The device according to claim 6, wherein the upper and lower ends of the pulse generator are each provided with a packer disk.

10. The device according to claim 9, wherein the diameter of the packer disk corresponds to the internal diameter of the screen of a production well.

* * * * *